United States Patent [19]

Fujikawa et al.

[11] Patent Number: 4,888,870

[45] Date of Patent: Dec. 26, 1989

[54] HAIR TRIMMER

[75] Inventors: Shouji Fujikawa, Ishibe; Masakatsu Araki; Fumihiro Kumano, both of Hikone; Shinichirou Tsujimura, Nagahama, all of Japan

[73] Assignee: Matsushita Electric Works, Ltd., Japan

[21] Appl. No.: 226,313

[22] Filed: Jul. 28, 1988

[30] Foreign Application Priority Data

Aug. 13, 1987 [JP] Japan ..... 62-202060
Dec. 15, 1987 [JP] Japan ..... 62-316671

[51] Int. Cl.[4] ..... B26B 19/00; B26B 13/00
[52] U.S. Cl. ..... 30/233.5; 30/200
[58] Field of Search ..... 30/34.2, 200, 233.5, 30/233, 240, 43.6, 346.51

[56] References Cited

U.S. PATENT DOCUMENTS

| | | | |
|---|---|---|---|
| 1,238,061 | 8/1917 | Bourdelat . | |
| 2,715,266 | 8/1955 | Haislip | 30/233.5 X |
| 2,933,809 | 4/1960 | McWilliams . | |
| 3,298,101 | 1/1967 | MacCarthy | 30/34.2 X |
| 3,811,185 | 5/1974 | Brenneman et al. | 30/34.2 X |
| 4,310,968 | 1/1982 | Buik et al. | 30/34.2 |
| 4,635,360 | 1/1987 | Tanahashi et al. | 30/34.2 |

FOREIGN PATENT DOCUMENTS 959167 9/1956 Fed. Rep. of Germany .

OTHER PUBLICATIONS

German Office Action of Feb. 6, 1989.

*Primary Examiner*—Douglas D. Watts
*Attorney, Agent, or Firm*—Stevens, Davis, Miller & Mosher

[57] ABSTRACT

A hair trimmer includes a cutting head 20 with an outer shearing foil 21 and an inner cutter 30 in hair shearing engagement with the shearing foil 21. The cutting head 20 is characterizee to have a hair guide surface 24 on its top and a skin engaging comb 40 for contact with the skin of the user. A number of hair introducing perforations 22 are formed in a portion 25 of the outer shearing foil 21 which is located below the hair guide surface 24 and extends in an inclined relation with respect thereto. The cutting head 20 is adapted in use to be advanced along the hair strands toward the tips thereof with the skin engaging comb 40 ahead of the hair guide surface 24. During this movement, the hair strands are combed into between the hair guide surface 24 and the skin and are then flexed outwardly upon leaving the hair guide surface 24 such that the tips of the hair strands are fed ito the perforations 22 in the inclined portion 25 behind the hair guide surface 24 in the advancing direction of the cutter head. Thus, the tips of the hair strands are captured by the perforations 22 due to their flexing back action while they are generally moving away therefrom, whereby effecting the shearing the hair strands only at their tips to provide a neat trimming finish.

20 Claims, 13 Drawing Sheets

HAIR TRIMMER

BACKGROUND OF THE INVENTION

1. Field of the Invention

The present invention is directed to a hair trimmer, and more particularly, to an electric hair trimmer which effects trimming by the use of an outer shearing foil and an inner cutting assembly.

2. Description of the Prior Art

A prior hair trimmer having an outer shearing foil and an inner cutter assembly is disclosed in the Japanese Patent Publication No. 50-18827 published on July 2, 1975. The device includes a hood which surrounds the outer shearing foil and defines an hair catch opening at its top end spaced upwardly of the shearing foil. The hood is formed on its top end with an inwardly extending flange which is adapted in use as a guide member to be held in contact with the head skin of the user during the manipulation of moving the device across the head skin. Also included in the hood is a crossbar which extends diametrically across the hair catch opening and is cooperative with the inward flange or guide member to lift up the hair strands for feeding the ends of hair strands to the shearing foil to be trimmed thereat. In this sense, the prior device is designed to advance through the hair against the stream of the hair strands for lifting or bristling up the hair strands. When the device is manipulated in such manner, it is very likely that the hair strands are directed into the hood with their tips leading and are therefore fed deep into the perforations of the shearing foil. The result is that some of the hair strands are excessively cut, failing to present an evenly trimmed hair style. In this respect, the prior hair trimmer device requires a considerable skill for avoiding such uneven trimming and is therefore found to be unsatisfactory for use by an unskilled person.

SUMMARY OF THE INVENTION

The above problem has been eliminated in the present invention which presents a hair trimmer of unique configuration. The hair trimmer in accordance with the present invention comprises a hand grip mounting thereon a cutting head. The cutting head comprises an outer shearing foil with a plurality of perforations and an inner cutter assembly driven to move in hair shearing engagement with the undersurface of the outer shearing foil. Formed on the top of the cutting head is a hair guide surface for guiding thereover hair strands to be trimmed. The perforations are formed in a portion located below the hair guide surface in an inclined relation thereto. Also included in the cutting head is a skin engaging comb which projects above the hair guide surface for combing the hair strands therepast and introducing the same into the perforations in inclined portion of the outer shearing foil behind the hair guide surface with respect to the advancing direction of the cutting head across the head of the user. Thus, by advancing the cutter head along the stream of the hair strands towards the tips thereof, the hair strands can be firstly flattened against the head skin by the hair guide surface and can be then flexed outwardly towards the adjacent inclined portion of the outer shearing foil after being released from the hair guide surface such that the tips of the hair strands past the hair guide surface can snap back into the perforations in the inclined surface to be sheared thereat. In this manner, the tips of the hair strands can be flipped into the perforations of the outer shearing plate while they are generally moving away from the inclined surface, whereby the hair strands can be prevented from being fed deep into the perforations and therefore can be sheared only at their tips and not sheared excessively.

Accordingly, it is a primary object of the present invention to provide a hair trimmer which is capable of shearing only the tips of the hair strands while moving the cutting head along the stream of the hair strands toward the tips thereof, enabling a smooth and even trimming operation even by an unskilled user.

In a preferred embodiment, the outer shearing foil is a dome-shaped circular member with a generally flattened top and a curved side surface depending from the circular periphery of the flattened top in an inclined relation with respect thereto. The flattened top is devoid of the perforations to define the hair guide surface, while the curved surface are formed with the perforations. The skin engaging comb is detachably mounted on the cutting head to facilitate the cleaning of the comb and as well the cutting head. In addition, the skin engaging comb can be substituted with a different one of skin engaging comb depending upon a particular trimming operation desired. In the preferred embodiment, two types of the combs are disclosed one provided with a number of upright bristles extending around the periphery of the outer shearing foil in a substantially perpendicular relation to the general plane of the hair guide surface, and the other provided with a number of teeth extending over the inclined side surface in a spaced relation thereto. The bristles and the teeth extend respectively from corresponding support rings detachable to the cutting head. The former type is suitable for trimming rather straight hairs, while the latter type is for trimming somewhat curled or straggling hairs as it keeps the hair strands smoothened just before they are sheared. Thus, the user is allowed to select a suitable comb for hair trimming depending upon differing hair styles.

It is therefore another object of the present invention to provide a hair trimmer in which the skin engaging comb is detachably mounted on the cutting head for facilitating the cleaning as well as for allowing the selective use of the different types of the combs.

Preferably, the upright bristles of the former type of the comb are capable of adjusting the amount of projection above the hair guide surface in order to vary the distance between the hair guide surface and the skin with which the bristles are kept in contact during the trimming operation. With this adjustable arrangement, the hair guide surface can exert a proper compression force to the hair strands for obtaining the above effect of flexing back the hair strands into the perforations of the shearing depending upon the amounts or thickness of the hair strands of the user.

It is therefore a further object of the present invention to provide a hair trimmer in which the projecting amount of the upright bristles of the comb can be adjusted depending upon the thickness or the amounts of the hair strands to be trimmed for presenting a consistent trimming effect.

Further, the upright bristles may be spring biased so as to constantly vary its amount of projection in conformity with the contour of the head skin of the user while moving the cutting head across the head of the user, thus enabling an automatic adjustment for obtaining a proper trimming effect for enhancing the convenience of using the hair trimmer, which is therefore a further object of the present invention.

In the latter type of the skin engaging comb in which the comb teeth extend from a portion of the support ring over the outer shearing foil, the support ring is rotatable about the outer shearing foil and lockable at at least two angularly displaced positions. Thus, the teeth can be adjusted its orientation optimum for manipulating the cutter head to move across the differing parts of the head, which is therefore a still further object of the present invention.

In the preferred embodiment, the hair guide surface of the dome-shaped outer shearing foil terminates at its periphery in a raised rim which extends along the upper edge of the inclined curved surface. The raised rim serves to effectively compress the hair strands for causing the tips of the hair strands to flex outwardly or snap back in a more amount upon releasing of the hair strands from the hair guide surface, thereby effectively feeding the tips of the hair strands for improved hair trimming performance.

It is therefore a further object of the present invention to provide a hair trimmer in which the tips of the hair strands can be fed into the perforations in an effective manner for obtaining an enhanced trimming operation.

The circular hair guide surface may be formed around its periphery with a number of comb projections for enhancing the combing effect also at the hair guide surface, thereby keeping the hair strands smoothened just before leaving the hair guide surface to improve the trimming action particularly for curled or straggling hairs.

It is therefore a further object of the present invention to provide a hair trimmer which is capable of effecting the trimming even for the curled or straggling hairs.

Further, the cutter head of the present invention includes a dust chute for recovering the clipped hairs. To this end, the inner cutter assembly has a fan which is received within a head space beneath the outer shearing foil and is driven to rotate together with the inner cutter assembly for drawing the air through the perforations of the shearing foil to produce a resultant air flow. The clipped hairs are carried on the air flow to be drawn into the cutting head and are flown radially outwardly into the chute through a port in the wall of the cutter head. With this arrangement, the clipped hairs can be safely recovered in the chute and prevented from scattering over the cutting head, thus greatly enhancing the convenience of using the hair trimmer, which is therefore a still further object of the present invention.

These and still other objects and advantages of the present invention will become more apparent from the following description of the preferred embodiments when taken in conjunction with the attached drawings.

DESCRIPTION OF THE PREFERRED EMBODIMENTS

First embodiment <FIGS. 1 to 5>

Figure 1:
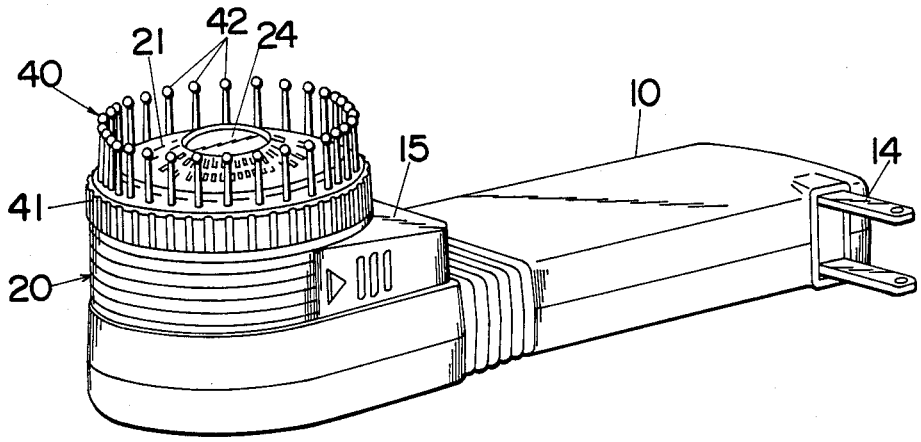
FIG. 1 is a perspective view of a hair trimmer in accordance with a first embodiment of the present invention.
Figure 2:
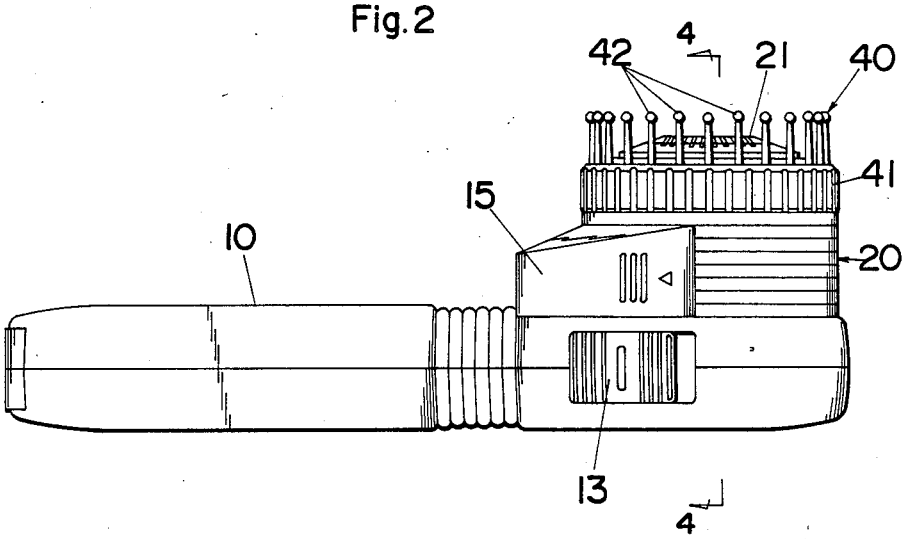
FIG. 2 is a side view of the hair trimmer.
Figure 3:
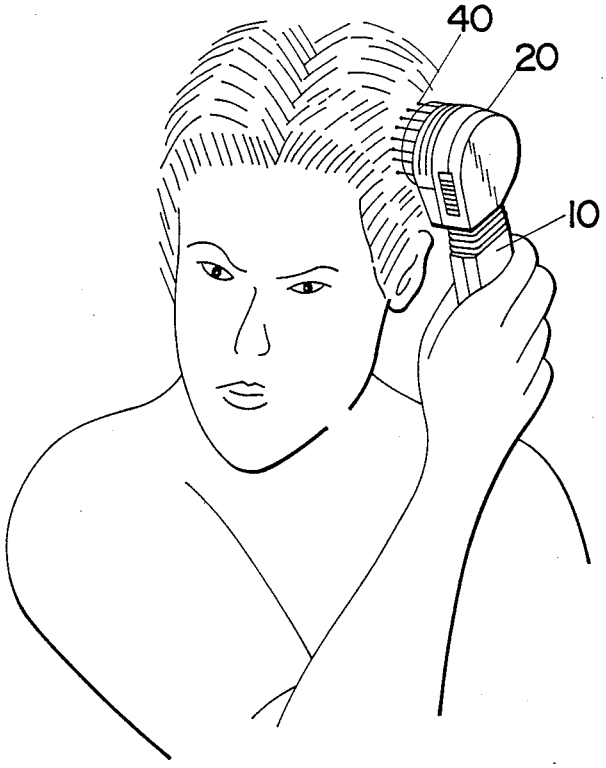
FIG. 3 is an explanatory view illustrating the manner of manipulating the hair trimmer.

Referring to FIGS. 1 and 2, there is shown a hair trimmer in accordance with a first embodiment of the present invention which comprises a handle grip 10 and a cutting head 20 mounted on one end of the handle grip 10. The cutting head 20 includes a circular outer shearing foil 21 with a number of perforations 22 which is held on a ring frame 23 detachably mounted on the top of the cutting head 20. Disposed within the cutting head 20 is a inner cutter assembly 30 which comprises a rotor block 31 carrying thereon a set of inner blades 32 urged in hair shearing relation to the undersurface of the outer shearing foil 21. The inner cutter assembly 30 receives an output shaft 12 of an electric motor 11 housed in the lower portion of the cutting head 20 and is driven thereby to rotate for shearing hairs entering the perforations 22 by the inner blades 32. The motor 11 is energized by a rechargeable battery (not shown) in the handle housing 10 and is turned on and off by the operation of a slide knob 13. The handle housing 10 is provided at the end opposite to the cutting head 20 with a retractable plug 14 which is adapted to be inserted in a conventional electrical outlet for recharging the incorporated battery.

The outer shearing foil 21 is shaped into a slightly domed configuration with a generally flattened top end 24 at its center portion and a curved side surface 25 depending from the periphery of the top end 24 in an inclined relation with respect thereto. The top end 24 is devoid of the perforations 22 and defines thereat a hair guide surface which functions to compress the hair strands against the head skin of the user, as will be explained hereinafter. The perforations 22 are distributed only in the inclined curved surface 25 for shearing the tips of the hair strands reaching the inclined surface 25.

Also mounted on the cutting head 20 is a skin engaging comb 40 which comprises a support ring 41 detachable to the portion around the periphery of the outer shearing foil 21 and a number of upright bristles 42 extending upwardly from the support ring 41. The bristles 41 are circumferentially spaced around the support ring 41 and project in a perpendicular relation to the general plane of the hair guide surface 24 up to a height thereabove so that they are adapted to be in contacting engagement with the skin when moving the cutting head across the skin of the user.

Figure 5A:
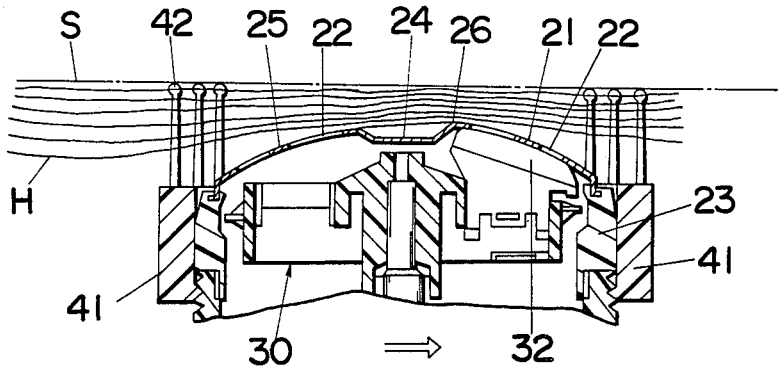
FIGS. 5A and 5B are explanatory views respectively illustrating the operation of the hair trimmer.
Figure 5B:
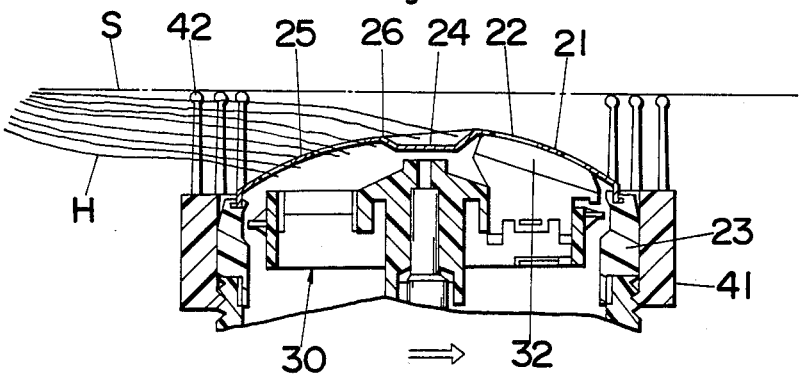

The operation of the hair trimmer is explained with reference to FIGS. 5A and 5B. As the cutting head 20 is manipulated to move along the stream of the hair strands H to the right or in the direction towards the tips of the hair strands, as shown in FIG. 5A, the comb 40 or the bristles 42 comb the hair strands over the shearing foil 21 during which the hair guide surface 24 act to flatten or compress the hair strands H against the skin S. Upon leaving the hair guide surface 24, the hair strands H are caused to flex outwardly, as shown in FIG. 5B, so that the tips of the hair strands flip against the inclined surface 25 behind the guide surface 24, entering the adjacent perforations 22 to be sheared thereat. In this manner, the tips of the hair strands H can be positively fed into the perforations 22 in their relative movement away from the shearing foil 21. Thus, only the tips of the hair strands can be sheared while preventing the hair strands from entering deep into the perforations, i.e., from being sheared excessively. With this result, the hair strands can be neatly trimmed without suffering from undesired deep shearing while moving the cutter head smoothly along the stream of the hair strands in the direction toward the tips thereof.

In the present embodiment, the hair guide surface 24 terminates at its periphery with a raised rim 26 which is continuous with the inclined curved surface 25. The raised rim 26 serves to improve the compression effect of the hair strands and to thereby obtaining an increased amount of the outward flexing of the hair strands upon leaving the raised rim 26 in order to effectively feed the tips of the hair strands into the perforations 22. In this connection, the upper shearing edge of the perforations 22 adjacent the rim 26 are spaced by a distance (indicated by the letter D in FIG. 4) of approximately 0.5 to 1.0 mm for avoiding accidental entry of the hair strands intermediate the ends thereof. Also, the inner end of the blade 32 extending beyond the upper shearing edge of the innermost perforations 22 by a distance (indicated by the letter S) of approximately 0.3 to 0.7 mm for preventing the inner blade 32 from accidentally engaging into the perforations 22.

Figure 4:
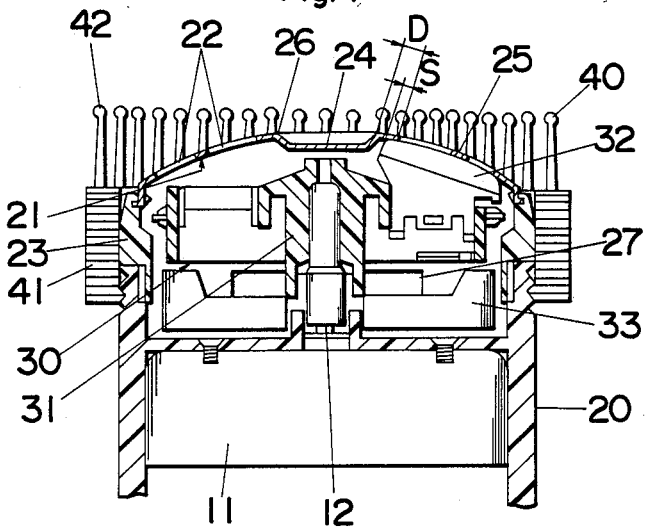
FIG. 4 is a cross section taken along line 4—4 of FIG. 2.

The cutting head 20 is also provided with a chute 15 for recovering the clipped hairs therein. The chute 15 is detachable to the side wall of the cutting head 20 and communicated with the interior of the cutting head 20 through a port 27 in the side wall, as shown in FIG. 4. Within the cutting head 20 below the outer shearing foil 21, there is provided a fan 33 which is integral with the rotor block 31 to be rotatable therewith. When the fan 33 is driven to rotate during the hair trimming operation, the fan 33 will draw the air from the outside through the perforations 22 and produce within the cutter head 20 an air flow directing radially outwardly. Thus, the clipped hairs are carried on the air flow and are flown outwardly into the chute 15 through the port 27 and are therefore prevented from scattering over the outer shearing foil 21. The chute 15 is provided with an escape vent (not shown) with a suitable filter which allows only the air to escaping therefrom while retaining the clipped hairs therein.

Figure 6:
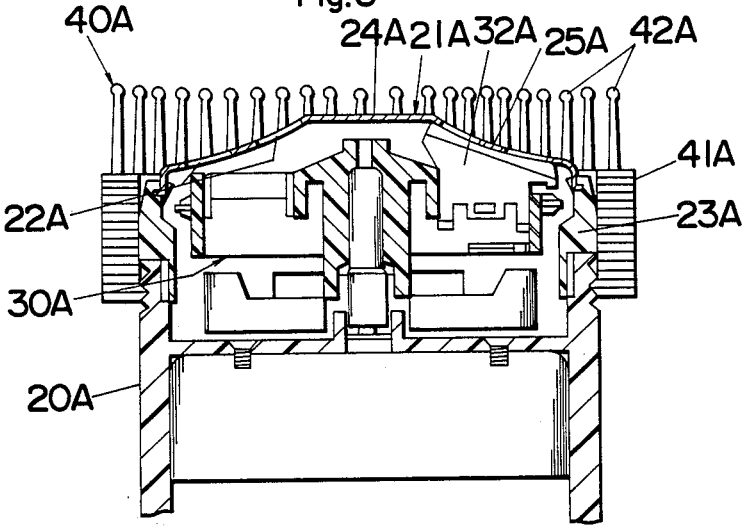
FIG. 6 is a sectional view similar to FIG. 4 but showing a hair trimmer in accordance with a first modification of the above embodiment.

Referring to FIG. 6, a first modification of the above embodiment is shown to have its inclined surface 25A slightly concaved with a radius of curvature at about 30 to 50 mm for smoothly feeding the tips of the hair strands. Two circumferential rows of perforations 22A are provided in the concave surface 25A with the perforations 22A in the inner row having a radial length of about 2.0 to 3.0 mm and with those in the outer row having a radial length of about 1.0 to 1.5 mm. The other structures are identical to those of the above embodiment and therefore like parts are designated by like numerals with the suffix letter A. Such designation applies to the following modifications [second to tenth] of the above first embodiment, that is, like parts are designated by like numerals with the corresponding suffix letters B to J.

Figure 7A:
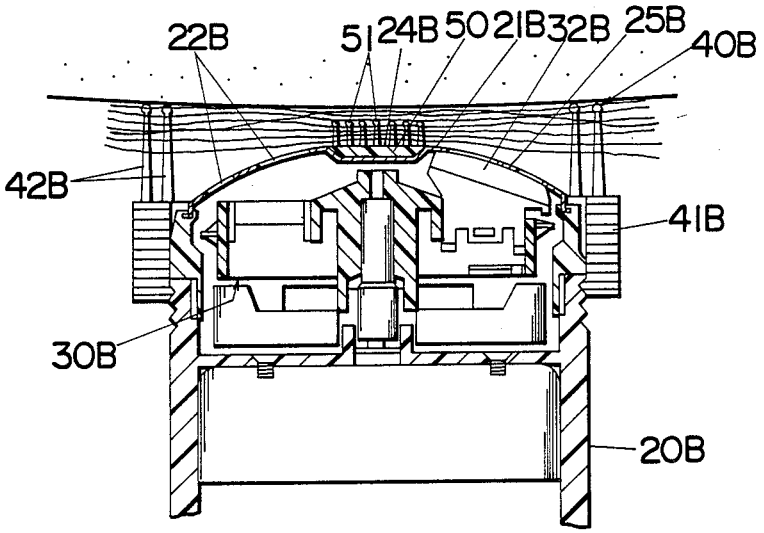
FIGS. 7A and 7B are explanatory views respectively illustrating the operation of a hair trimmer in accordance with a second modification of the above embodiment.
Figure 7B:
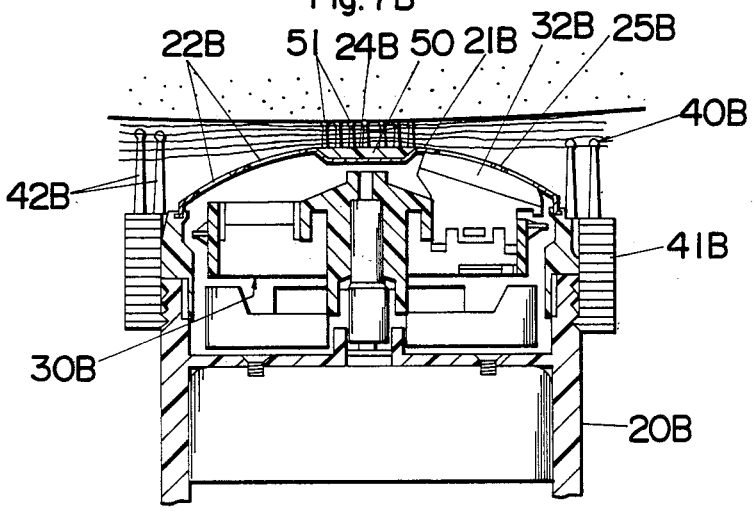
Figure 8:
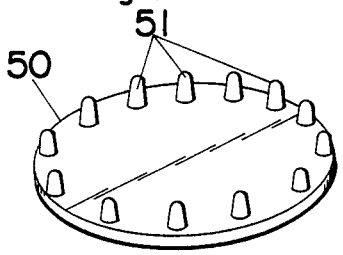
FIG. 8 is a perspective view of a comb disk utilized in the second modification.
Figure 9:
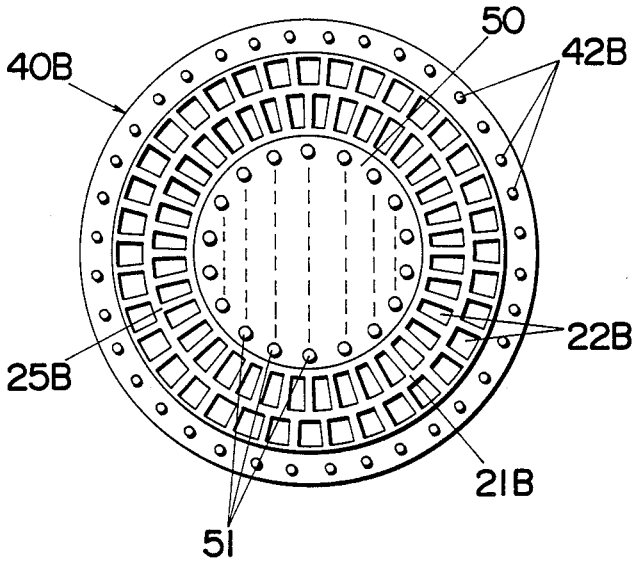
FIG. 9 is a top view of the cutting head of the second modification.

FIGS. 7 to 9 show a cutting head 20B of the second modification in which the hair guide surface 24B includes an additional set of bristles 51 for continuously combing the hair strands which are being compressed by the hair guide surface 24B. This is particularly advantageous for trimming curled or straggling hairs since they are constantly combed until they left the hair guide surface 24B. The bristles 51 is held on a comb disk 50 which is fixed on the top of the outer shearing foil 21B and defining the hair guide surface 24B. As shown in FIG. 9, the bristles 51 are provided in even numbers and circumferentially arranged on the comb disk 50 such that every two perforations 22B are aligned on a line parallel to the other lines on which the other two perforations 22B are aligned, thus enhancing to smoothen the hair strands by the additional bristles 51. Another feature of this modification resides in that the skin engaging comb 40B is capable of adjusting its vertical position relative to the hair guide surface 24B so as to vary the amount of compression to which the hair strands are subjected between the comb disk 50 and the skin of the head, as shown in FIGS. 7A and 7B. This is contemplated to effect the trimming equally for the hairs on various parts of the head with differing amounts or thickness of the hairs.

Figure 10:
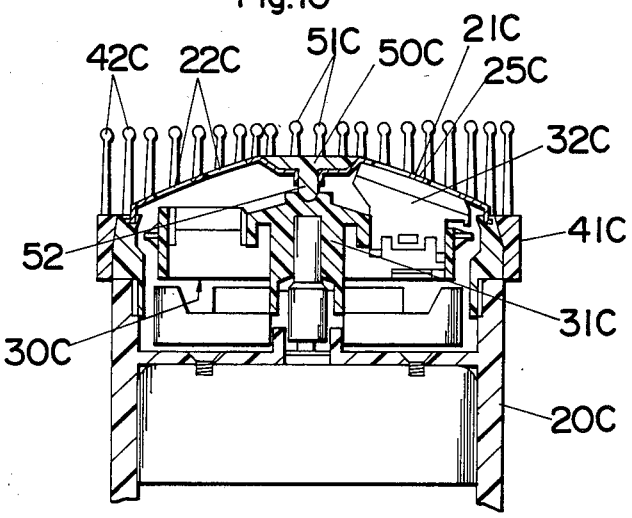
FIG. 10 is a sectional view of a cutting head in accordance with a third modification of the above embodiment.

In the third modification of FIG. 10, like comb disk 50C with bristles 51C is secured to the outer shearing foil 21C with a downward projecting stud 52 fixedly engaged in the center of the outer shearing foil 21C. The lower end of the stud 52 is in bearing engagement with the top center of the rotor block 31C for stably holding the same in an exact axial position during the rotary movement thereof.

Figure 11:
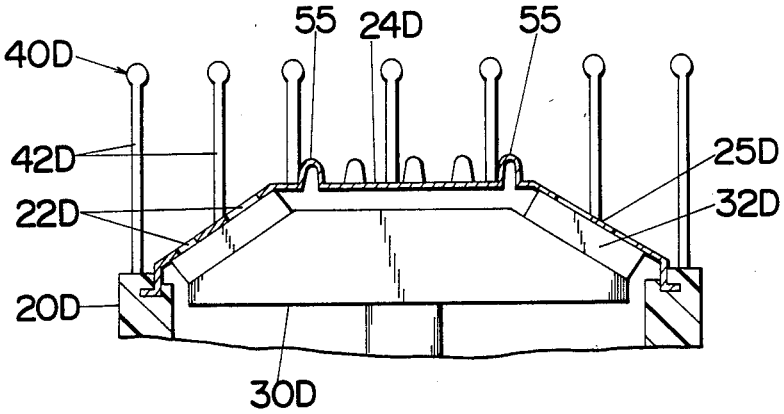
FIG. 11 is a sectional view of a cutting head in accordance with a fourth modification of the above embodiment.
Figure 12:
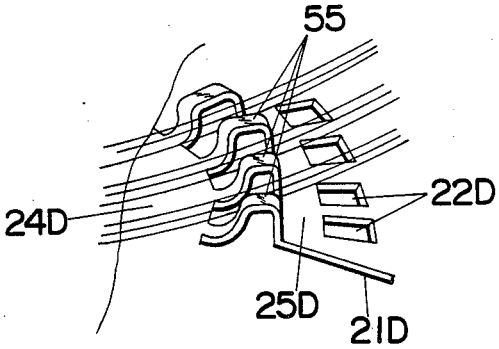
FIG. 12 is a partial perspective view of the cutting head of FIG. 11.

FIGS. 11 and 12 show a cutting head 20D of the fourth modification which is characterized in that the hair guide surface 24D is provided along its periphery with a number of comb projections 55. The comb projections are integrally formed with the outer shearing foil 21D as being blanked therefrom and are circumferentially spaced to perform the like combing effect as the bristles 51 in the second modification. The support ring from which the upright bristles 42D extend is integrally formed with the cutting head 20D.

Figure 13:
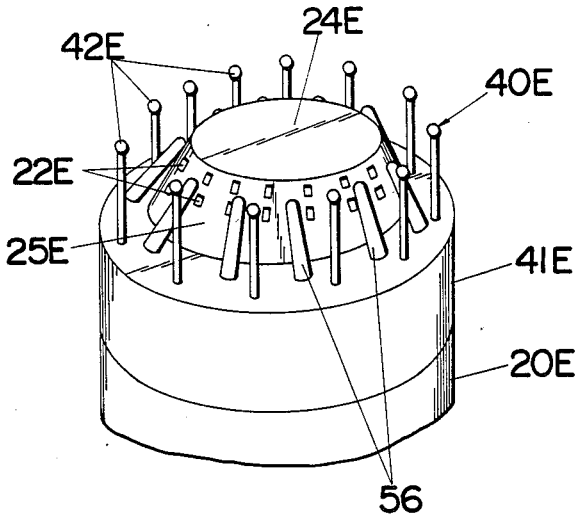
FIG. 13 is a perspective view of a cutting head in accordance with a fifth modification of the above embodiment.
Figure 14:
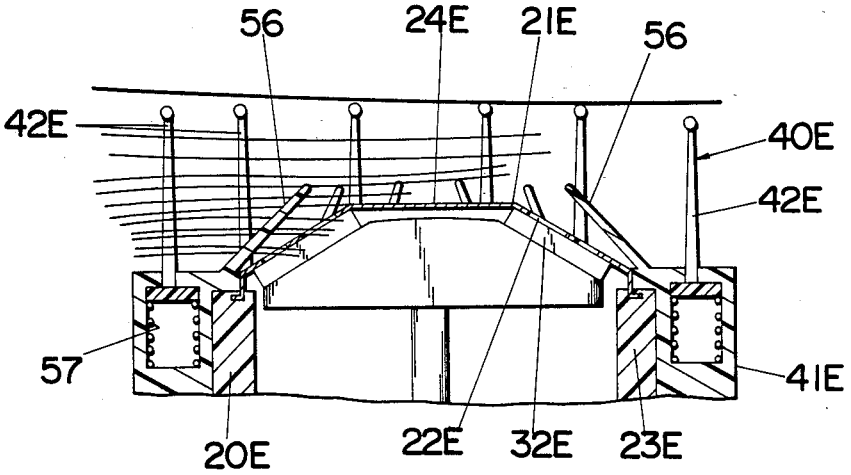
FIG. 14 is a sectional view illustrating the operation of the cutting head of FIG. 13.

FIGS. 13 and 14 show a cutting head 20E of the fifth modification in which a skin engaging comb 40E includes, in addition to upright bristles 42E, oblique comb teeth 56 extending from a support ring 41E and circumferentially spaced therealong. The comb teeth 56 project over an inclined curved surface 25E up to a point above the hair guide surface 24E in an oblique relation to the surface 25E for combing the hair strands on the hair guide surface 24E in cooperation with the upright bristles 42E. In this modification, the upright bristles 42E have their lower ends floatably seated within the support ring 41E to be vertically movable and are urged by springs 57 upwardly into a position. Thus, by varying the pressing force applied to the cutting head 20E it is possible to variably adjust the distance between the hair guide surface 24E and the skin, and therefore the amount of compression exerted on the hair strands so as to obtain an optimum trimming effect.

Figure 15:
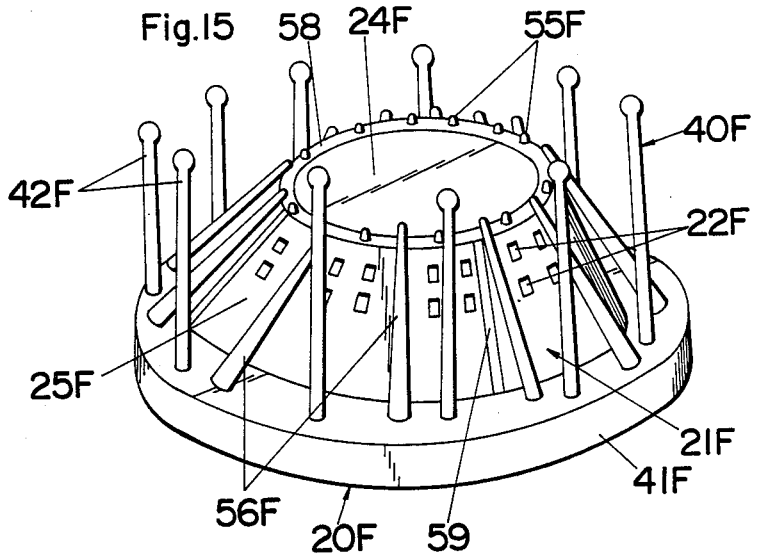
FIG. 15 is a perspective view of a cutting head in accordance with a sixth modification of the above embodiment.
Figure 16:
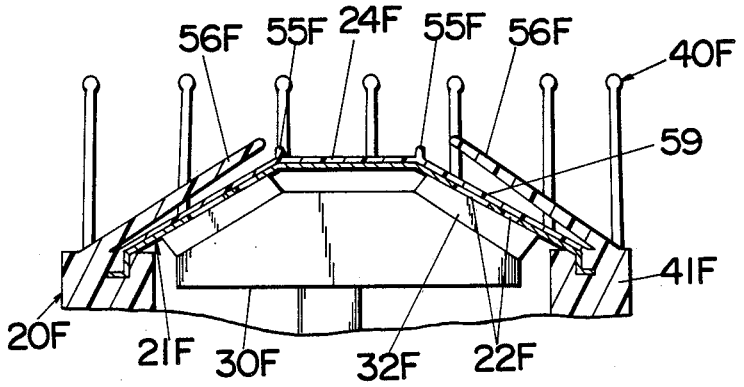
FIG. 16 is a sectional view of the cutting head of FIG. 15.

FIGS. 15 and 16 show a cutting head 20F of the sixth modification which is similar to the above fifth modification except that a number of comb projections 55F are added on the periphery of the hair guide surface 24F. The comb projections 55F are formed on an annulus 58 which is placed on the periphery of the hair guide surface 24F. The annulus 58 is integrally connected to the support ring 41F by means of radial ribs 59 which are circumferentially spaced and lie on the inclined curved surface 25F. In this modification, the support ring 41F is integral with the cutting head 21F to forming the peripheral part of thereof.

Figure 17:
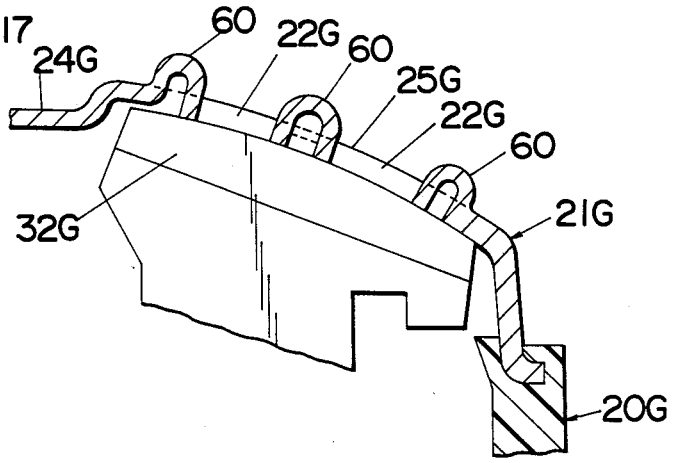
FIG. 17 is a partial sectional view of a cutting head in accordance with a seventh modification of the above embodiment.

FIG. 17 shows a cutting head 20G of the seventh modification in which the outer shearing foil 21G is formed at its inclined surface 25G with sets of comb projections 60 integrally projecting from the outer shearing foil 21G and spaced circumferentially over the inclined surface 25G. The comb projections 60 in each set are radially aligned for combing the hair strands between the adjacent sets of the comb projections 60 toward the hair guide surface 24G. This configuration can be effective for combing the hair strands towards the hair guide surface 24G alone or in combination with the bristles on the hair guide surface 24G.

Figure 18:
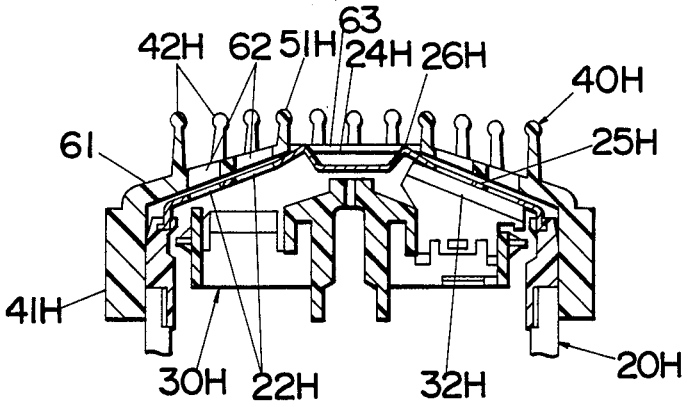
FIG. 18 is a sectional view of a cutting head in accordance with an eighth modification of the above embodiment.
Figure 19:
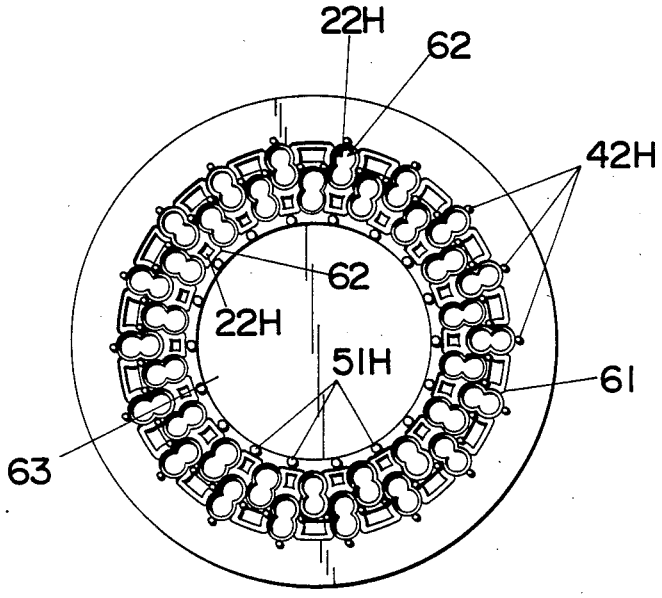
FIG. 19 is a top view of a screen covering the cutting head of FIG. 18.

FIGS. 18 and 19 show a cutting head 20H of the eighth modification in which a skin engaging comb 40H includes a screen 61 integrally extending from the support ring 41H and covering the inclined surface 25H of the outer shearing foil 21H. The screen 61 is provided with a corresponding number of apertures 62 which are respectively in registration with the perforations 22H in the inclined surface 25H and which are slightly larger than the perforations 22H for feeding the hair strands thereinto. The screen 61 is also formed along the periphery of a center opening 63 with a number of bristles 51H which are circumerentially arranged. The hair guide surface 24H with the raised rim 26H is exposed in the center opening 63 of the screen 61.

Figure 20:
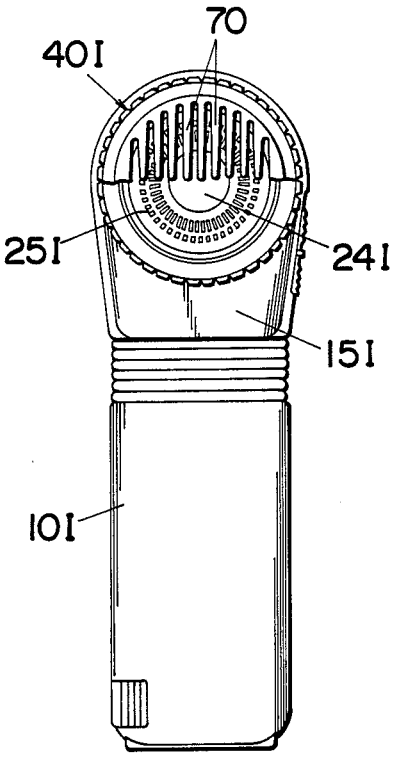
FIGS. 20 and 21 are respectively a top view and a side view of a hair trimmer in accordance with a ninth modification of the above embodiment.
Figure 21:
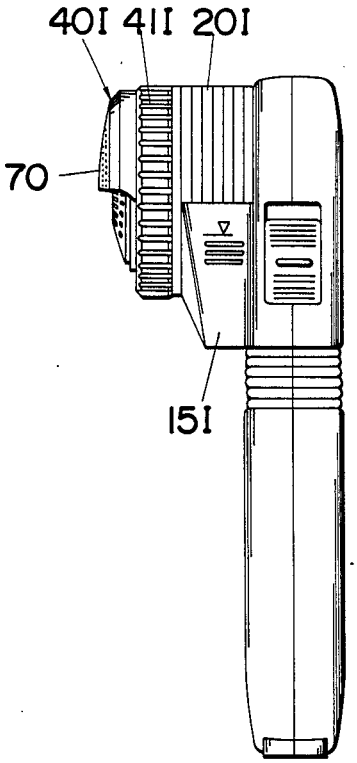
Figure 22:
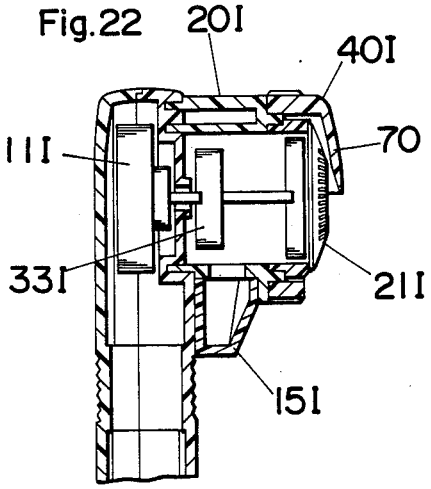
FIG. 22 is a sectional view of the cutting head of FIG. 20.

FIGS. 20 to 22 show a hair trimmer in accordance with the ninth modification which includes a skin engaging comb 40I with a set of parallel comb teeth 70 extending from a portion of the periphery of a support ring 41I. The comb teeth 70 extend over the inclined surface 25I in a spaced relation thereto and terminate at its free end in a line diametrically transversing the general surface of the outer shearing foil 21I so that some middle teeth reach the hair guide surface 24I on top of the shearing foil 21I. With the use of this skin engaging comb 40I, the hair strands can be kept sized or smoothed by the comb teeth 70 even while the tips of the hair strands are being sheared at the inclined surface 25I which is located behind the hair guide surface 24I with respect to the direction of advancing the cutting head 20I, thereby giving rise to a neatly finished trimming. The teeth 70 may extend over into the opposite half of the shearing foil or may extend short of the hair guide surface, as in the following modification. In this modification, the skin engaging comb 40I is detachably mounted on the cutting head 20I so that it can be replaced by another skin engaging comb, for example, the one having the upright bristles as utilized in the first embodiment. Further, the support ring 41I of the skin engaging comb 40I is rotatably attached around the cutting head 20I and is lockable by suitable means thereto at two opposite positions 180° apart from each other. Thus, the comb 40I can be held selectively in one of the two positions in which the comb teeth 70 are oriented oppositely. That is, the orientation of the comb teeth 70 with respect to the length of the handle grip 10I can be altered in order to smoothly manipulate the cutting head 20I along the hair strands on differing parts of the head without giving rise to jerky motions in handling the hair trimmer.

Figure 23:
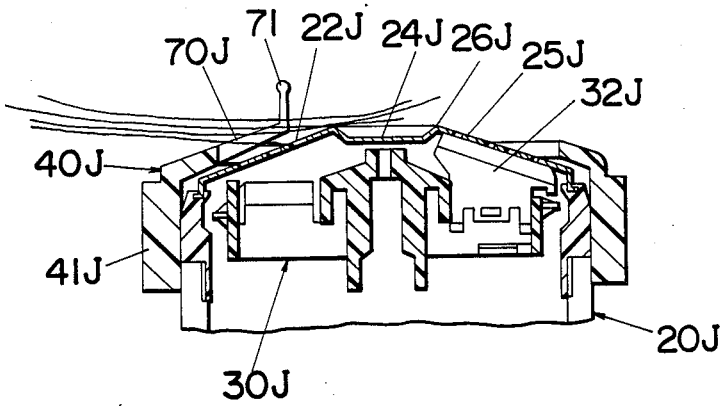
FIG. 23 is a sectional view illustrating the operation of a cutting head in accordance with a tenth modification of the above embodiment.
Figure 24:
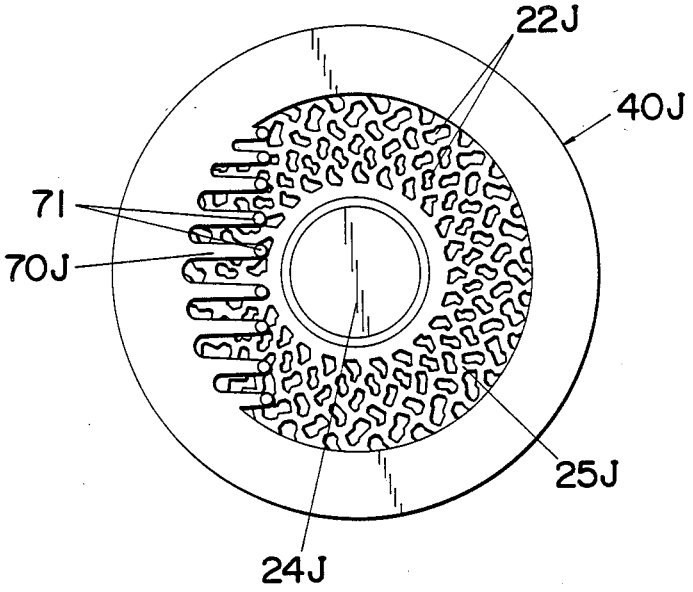
FIG. 24 is a top view of the cutting head of FIG. 23.

FIGS. 23 and 24 show the cutting head 20J of the tenth modification in which the comb teeth 70J extend a short length but have at their respective ends upright bristles 71 projecting above the hair guide surface 24J for contact with the skin. In this modification, it is also contemplated to provide the perforations 22J of larger dimension at the portion remote from the hair guide surface 24J than at the portion adjacent thereto in order to increase hair capturing efficiency at the peripheral portion of the inclined surface 25J. Although not shown in the figures, the comb teeth 70J may terminate at an arcuate line running around the periphery of the hair guide surface 24J instead of terminating at a straight line, as shown in FIG. 24.

Second embodiment <FIGS. 25 to 28>

Figure 25:
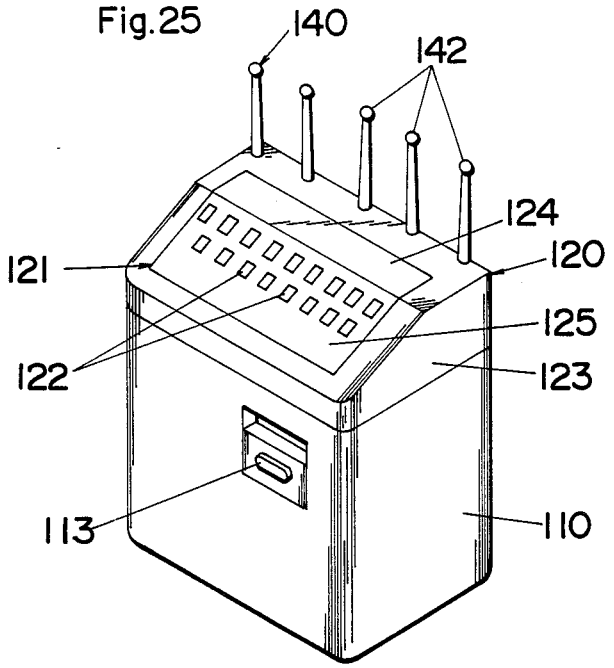
FIG. 25 is a perspective view, in schematic representation, of a trimmer in accordance with a second embodiment of the present invention.
Figure 26:
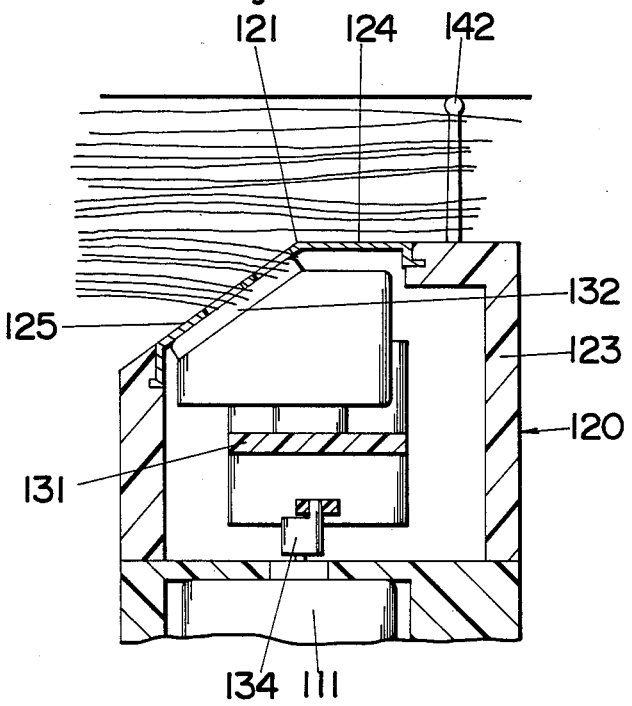
FIG. 26 is view illustrating the operation of the hair trimmer of FIG. 25.
Figure 27A:
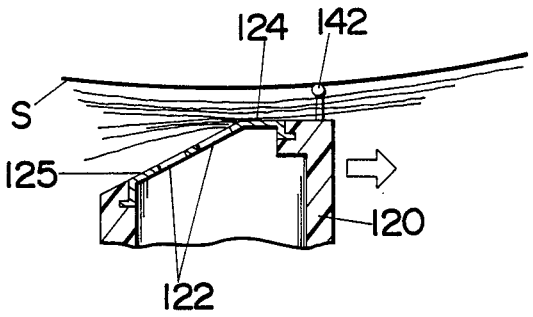
FIGS. 27A and 27B explanatory views respectively illustrating the operation of the hair trimmer of FIG. 25.
Figure 27B:
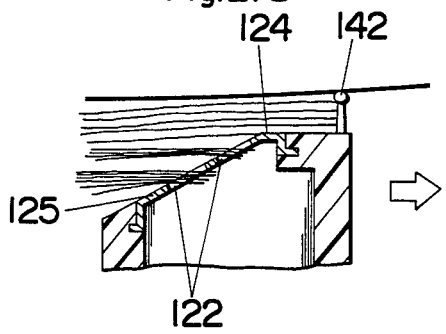
Figure 28:
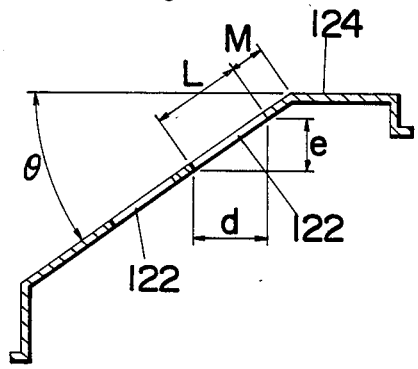
FIG. 28 is a sectional view of an outer shearing foil of the hair trimmer of FIG. 25 presented for explanation of the hair trimming mechanism.

Referring to FIG. 25, a hair trimmer in accordance with a second embodiment of the present invention is shown to comprise a handle grip 110 mounting at its top end a generally rectangular cutting head 120. The cutting head 120 comprises a head frame 123 carrying a generally rectangular outer shearing foil 121 composed of a top flat surface 124 and an inclined flat surface 125 depending therefrom. Perforations 122 are formed only in the inclined surface 125 for shearing hairs in cooperation with inner blades 132 driven in a reciprocation path along the length of the outer shearing foil 121. The top flat surface 124 devoid of the perforations defines a hair guide surface which have the same function as in the previous embodiment. As shown in FIG. 26, the inner blades 132 are held on an inner block 131 connected to an electric motor 111 through a drive element 134 which translates the rotary motion of the motor into the reciprocatory motion of the block 131. The head frame 123 is also formed at its top adjacent the hair guide surface 124 with a skin engaging comb 140 having a row of bristles 142 arranged along the lengthwise edge of the hair guide surface 124. Also in this embodiment, the cutting head 120 is in use to be advanced along the direction of the hair strands toward the tips thereof with the comb 140 ahead of the hair guide surface 124, or, moved from the left to the right in FIGS. 27A and 27B. During which movement, the hair strands are continuously smoothened by the comb 140 followed by being compressed between the hair guide surface 124 and the skin S, and are then caused to flex outwardly toward the inclined surface 125 immediately upon leaving the hair guide surface 124, so as to feed the tips thereof into the perforations 122 in the inclined surface 125 to be sheared thereat. The shearing mechanism can be explained with reference of FIG. 28 illustrating in schematic representation the relation between the hair guide surface 124 and the inclined surface 125 with the perforations 122, which is therefore also representative of the first embodiment. Since the tips of the hair strands are fed into the perforations 125 while the cutting head 120 is advanced through the hair strands towards the tips thereof, the amount of projection into the perforation 122, i.e., the cut length of the hair strand can be determined by the angle $\theta$ of the inclined surface with respect to the hair guide surface 124, the length L and the depth of the perforation 122. Preferably, the inclination angle $\theta$ is in the range of 30° to 50°, the length L is between 2.0 to 3.0 mm, and the depth is between 1.0 to 1.5 mm. In this connection, a margin M of about 0.5 to 1.0 mm is preferred between the edge of the hair guide surface 124 and the upper edge of the adjacent perforation for preventing accidental entry of the hair strands at the intermediate portion thereof into the perforations.

What is claimed is:

1. A hair trimmer comprising:

a handle grip;

a cutting head mounted on said handle grip and including an outer shearing foil with a plurality of perforations and an inner cutter assembly driven to move in hair shearing engagement with the undersurface of said outer shearing foil;

said cutting head being formed on its top with a hair guide surface for guiding thereover hair strands;

said outer shearing foil having said perforations in a portion which is located below said hair guide surface in an inclined relation with respect thereto;

said cutting head including a skin engaging comb which projects above said hair guide surface for combing the hair strands therepast as the cutting head is moved across the head skin of the user, whereby the hair strands after passing said hair guide surface are caused to flex toward the inclined portion of the outer shearing foil behind said hair guide surface with respect to the advancing direction of the cutting head such that only the tips of the hair strands are allowed to be fed due to the above flexing into the perforations of that inclined portion of the outer shearing foil and sheared thereat.

2. A hair trimmer as set forth in claim 1, wherein said skin engaging comb comprises a number of upright bristles projecting perpendicular to the general plane of the hair guide surface.

3. A hair trimmer as set forth in claim 1, wherein said skin engaging comb comprises a number of teeth extending over the outer shearing foil in a spaced relation thereto.

4. A hair trimmer as set forth in claim 1, wherein said outer shearing foil is a dome-shaped circular member with its flattened top defining said hair guiding surface and with its curved surface defining said inclined portion having said perforations, said hair guiding surface terminating at its periphery in a raised rim extending along the upper circular edge of said inclined portion.

5. A hair trimmer as set forth in claim 1, wherein said skin engaging comb is movably supported on the cutting head so as to be capable of varying its amount of projection above said hair guide surface.

6. A hair trimmer as set forth in claim 1, wherein said inclined portion of the outer shearing foil is formed with a number of comb projections for combing the hair strands between the adjacent ones thereof.

7. A hair trimmer comprising:

a handle grip;

a cutting head mounted on said handle grip and including a circular outer shearing foil with a plurality of perforations and an inner cutter assembly driven to rotate in hair shearing engagement with the undersurface of said outer shearing foil;

said outer shearing foil being a dome-shaped member with a generally flattened top and a curved side surface depending from the periphery of the flattened top in an inclined relation with respect thereto, said flattened top being devoid of said perforations and defining a hair guide surface for guiding thereover hair strands, said curved surface being formed with said perforations;

said cutting head including a skin engaging comb which projects above said hair guide surface for combing the hair strands therepast as the cutting head is moved across the head skin of the user, whereby the hair strands after passing said hair guide surface are caused to flex toward the inclined portion of the outer shearing foil behind said hair guide surface with respect to the advancing direction of the cutting head such that only the tips of the hair strands are allowed to be fed due to the above flexing into the perforations of that inclined portion of the outer shearing foil and sheared thereat.

8. A hair trimmer as set forth in claim 7, wherein said skin engaging comb is detachably mounted to said cutting head.

9. A hair trimmer as set forth in claim 7, wherein said hair guiding surface terminates at its periphery in a raised rim extending along the upper edge of said inclined curved surface.

10. A hair trimmer as set forth in claim 7, wherein said hair guide surface is formed at its periphery with a number of comb projections which are circumferentially spaced for combing the hair strands between the adjacent ones of the comb projections.

11. A hair trimmer as set forth in claim 10, wherein said comb projections are integrally formed with the outer shearing foil.

12. A hair trimmer as set forth in claim 10, wherein said comb projections are formed on a disk fitted over the hair guide surface.

13. A hair trimmer as set forth in claim 7, wherein said inner cutter assembly includes a fan received within a head chamber under the outer shearing foil, said fan being driven to rotate together with said inner cutter assembly for drawing the air through the perforations in said outer shearing foil and producing a resultant air flow by which the clipped hairs are flown radially outwardly through a port in the wall of the cutter head and recovered in a chute detachably mounted on said cutting head.

14. A hair trimmer as set forth in claim 7, wherein said skin engaging comb comprises upright bristles extending upwardly above said hair guide surface and arranged around the outer periphery of said outer shearing foil.

15. A hair trimmer as set forth in claim 14, wherein said skin engaging comb further includes a number of comb teeth which extend over the inclined curved surface of the outer shearing foil towards said hair guide surface.

16. A hair trimmer as set forth in claim 14, wherein said bristles are movably supported at their lower end and are spring biased upwardly.

17. A hair trimmer as set forth in claim 7, wherein said skin engaging comb comprises a support ring extending around the periphery of said cutting head and upright bristles extending upwardly from said support ring, said support ring including a screen extending over the inclined curved surface, said screen having a number of holes which are in registration with said perforations in the outer shearing foil and are sized to be larger than the perforations.

18. A hair trimmer as set forth in claim 7, wherein said outer shearing foil has perforations which are larger at the portion remote from said hair guide surface than at the portion adjacent thereto.

19. A hair trimmer as set forth in claim 7, wherein said skin engaging comb comprises a support ring detachable to said cutting head and comb teeth extending over said outer shearing foil from a portion of said support ring in generally parallel relation to each other, said support ring being rotatable around said outer shearing foil and lockable at at least two angularly displaced positions.

20. A hair trimmer as set forth in claim 7, wherein said outer shearing foil is concaved at its inclined curved surface with the perforations.

* * * * *